United States Patent [19]

Meredith

[11] 4,235,008

[45] Nov. 25, 1980

[54] METHOD OF GUTTER CONSTRUCTION FOR SWIMMING POOLS

[76] Inventor: David L. Meredith, 5911 Founders Dr., Greensboro, N.C. 27410

[21] Appl. No.: 39,853

[22] Filed: May 17, 1979

Related U.S. Application Data

[62] Division of Ser. No. 887,538, Mar. 17, 1978, abandoned.

[51] Int. Cl.[3] ..... B23P 19/00; B32B 31/00

[52] U.S. Cl. ..... 29/428; 29/DIG. 47; 4/510; 52/169.5; 156/244.13; 156/244.18; 156/252; 264/209; 264/294; 264/320

[58] Field of Search ..... 29/428, DIG. 47; 4/172.95, 172.17, 172.21; 264/340, 209, 339, 294, 320; 52/169.5; 210/169; 156/244.13, 244.18, 252, 259, 242

[56] References Cited

U.S. PATENT DOCUMENTS

| | | | |
|---|---|---|---|
| 2,692,421 | 10/1954 | Cozzo | 29/DIG. 47 UX |
| 3,249,668 | 5/1966 | Scragg et al. | 264/209 X |
| 3,296,661 | 1/1967 | De Moustier | 264/209 X |
| 3,319,264 | 5/1967 | Scarano | 4/172.17 |
| 3,445,922 | 5/1969 | Leghorn | 264/294 UX |
| 3,518,147 | 6/1970 | Harmsen | 156/252 |
| 3,837,957 | 9/1974 | Mesnel | 156/244.13 X |
| 3,884,741 | 5/1975 | Sexstone | 156/259 |
| 3,923,230 | 12/1975 | Patterson et al. | 4/172.17 X |
| 4,080,670 | 3/1978 | Van Den Broek | 4/172.17 |
| 4,084,272 | 4/1978 | Laven | 52/169.5 X |

*Primary Examiner*—Charlie T. Moon

[57] ABSTRACT

A gutter construction for the periphery of swimming pools is formed of at least two prefabricated members joining together. First is a main gutter member which is molded from a longitudinally slit, plastic cylindrical material and includes a vertical rear wall and a horizontal bottom wall extending forwardly from the lower edge of the rear wall. A front rim member is also molded from a tubular plastic material and has the lower wall thereof secured to the upper surface of the main gutter member near the front or free edge thereof. A perforated gutter cap rests atop the upper edge of the rear wall of the main gutter member and the juncture of the lip and rear wall of the tubular member which forms a seat for the front edge of the gutter cap. All of the members, i.e. the main gutter member, the rim member and the gutter cap are fabricated from a tubular plastic stock, such stock being cut (in the cases of the main gutter member and gutter cap), heated, and reshaped to form the components of the gutter construction.

2 Claims, 3 Drawing Figures

METHOD OF GUTTER CONSTRUCTION FOR SWIMMING POOLS

This is a division, of application Ser. No. 887,538, filed Mar. 17, 1978, now abandoned.

BACKGROUND OF THE INVENTION

In the last few years swimming pool gutter construction has undergone substantial changes. From a time prior to 1960 when the plumbing for swimming pools was usually buried in the soil surrounding the swimming pool, gutters have now been provided extending around the perimeter of the pool which include one trough for collecting surge water that flows over the top of the gutter rim thereinto and delivers it to a filter, and a second passageway or pipe through which filtered water is delivered and returned to the pool. Examples of such prior construction are illustrated in the Ogden U.S. Pat. No. 2,932,397, particularly FIG. 5, which shows the basic idea of collecting and returning water utilizing the gutter rather than underground piping; the Scarano U.S. Pat. No. 3,319,264 which shows a plastic, dual channel gutter construction; the Patterson et al U.S. Pat. No. 3,923,230 which shows a welding procedure for fabricating and assembling sheet metal into a dual channel gutter construction. Other patents show similar approaches.

In most of the approaches in the above listed patents, with the exception of the Scarano patent, the gutter construction is formed from sheet metal or precast concrete sections, all of which are relatively expensive and difficult to install. The gutter construction shown in the Scarano patent is relatively simple to install, however, utilizes an expensive extruded plastic section in which the water returning to the pool is transmitted back through a passageway above the trough which carries the water being collected. Also there is a relatively small V-shaped groove which collects the water surging over the sides of the gutter assembly with the result that much of the surge water returns to the pool rather than into the lower chamber 21.

Therefore, while various gutter constructions are available all suffer from one disadvantage; that is that they are relatively more expensive than need be because of expensive die costs in the case of plastic gutter construction and because of the substantial labor and skilled labor involved in the installation of the metal guttering.

SUMMARY OF THE PRESENT INVENTION

The present invention provides considerable economies in the gutter construction both from the standpoint of cost of material and from the standpoint of installation time and cost. Toward this end, the present gutter construction is an all plastic approach in which each of the two or three components of the gutter are fabricated from conventionally available cylindrical tube stock.

The gutter of the present invention, in general, includes a main gutter member which is an L-shaped plastic member having a vertical rear wall and a horizontal bottom wall which is initially laid into a preformed recess in the foundation. The main gutter member is formed by making a longitudinal cut in the cylindrical stock material, then heating and bending the plastic in a proper mold to form the L-shaped main gutter member. The rim member is also formed from cylindrical sheet stock which may, if desired, be of a different wall thickness than the main gutter member.

The rim member is formed by merely heating cylindrical stock and reshaping it into a desired polygonal cross-section. Finally, a gutter cover or cap which is a flat, perforated sheet of plastic is formed by cutting a cylindrical piece of stock material longitudinally, heating and bending it out flat, then providing perforations therethrough.

In installation the members are formed in sections or lengths of a predetermined size, probably about six feet in length. The main gutter member is first laid into the foundation, then the rim member is bonded to the upper front edge portion of the gutter member with an epoxy putty. The shape of the rim member is such that the rear wall includes a seat for holding one edge of the cover or cap member while the other edge rests atop the upper edge of the rear wall of the gutter member. The cover member is not permanently secured as it may be desired to be lifted away for access thereinto. The main gutter member includes one or more outlets connected to the filter, or in some cases a surge tank, and water surging over the edge of the rim is continuously passed on to the surge tank or filter, then returned through the tubular rim member and back out into the swimming pool through proper outlets therein.

Such construction and installation eliminates the costly, time consuming welding operations as are necessary in sheet metal work. Also, the tendency for bending or warping due to the welding is also eliminated. Further the plastic components are fabricated from conventional shapes of stock material and therefore no expensive extrusion dies are necessary. As an added benefit, in some cases, the rim member alone may be applied to existing gutters to provide a second return conduit without necessarily providing the main gutter member.

It is therefore an object of the present invention to provide an improved construction for swimming pool gutters.

It is another object of the present invention to provide an improved swimming pool gutter construction that offers considerable savings as far as the cost of materials and labor is concerned.

It is yet another object of the present invention to provide a gutter construction for swimming pools in which the components are all fabricated from conventionally available stock plastic material.

Other objects and a fuller understanding of the invention will become apparent from reading the following detailed description of a preferred embodiment along with the accompanying drawings in which.

DESCRIPTION OF A PREFERRED EMBODIMENT

Figure 1:
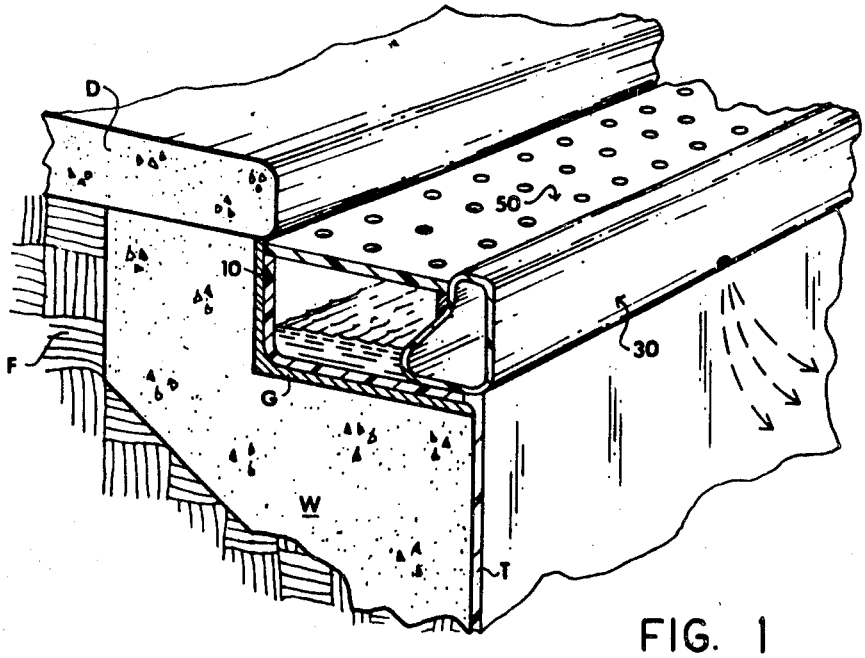
FIG. 1 is a sectionalized perspective view illustrating the present invention in its assembled relationship with respect to the foundation, deck, and side wall of the pool.

Turning now to the drawings and particularly to FIG. 1, there is illustrated the environment in which the gutter construction according to the present invention is used. First of all, in construction of a swimming pool a foundation F is dug. A poured concrete or cast concrete wall section W which includes a tile wall T or inner wall of other material is then emplaced in the foundation, and a deck D of concrete, tile or other similar materials. In conventional pools the deck D is spaced outwardly and above the upper edge of the inner tile wall T and a semi-rectangular ledge or the like connects the upper edge of wall T and the edge of deck D. The inner surface of the rectangular cut out is provided with a grouting or cement material G lining the walls thereof.

The gutter construction then, according to the present invention, is basically a three piece assemblage including a main L-shape gutter member 10, a tubular rim member 30, and a cover plate or cap 50, all of these components being formed of a plastic or moldable material. The tubular member 30 is bonded to the front edge of the L-shaped gutter member and the cap 50 is mounted atop the edge of the gutter member and a seating means in the tubular member.

Figure 2:
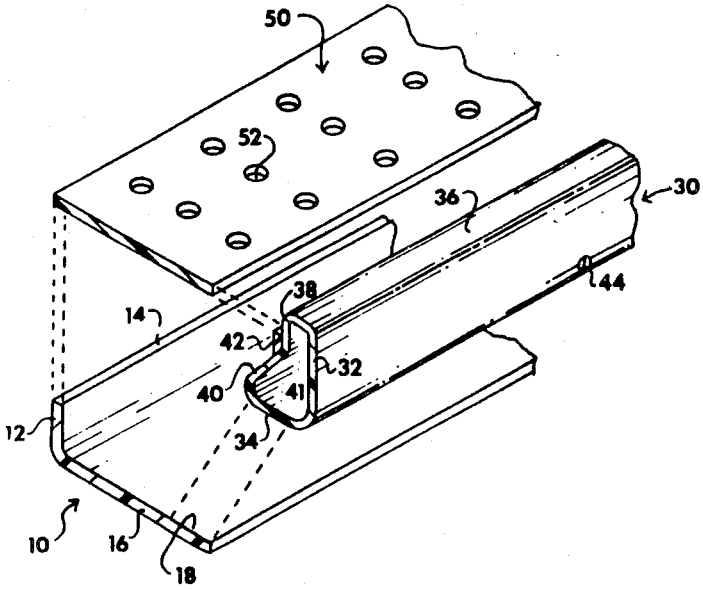
FIG. 2 is a sectionalized perspective view, similar to FIG. 1, except showing the components of the gutter construction only and in an exploded relationship with each other.

As evident from FIG. 2 the L-shaped main gutter member is formed with a substantially vertical rear wall 21 and a horizontal bottom wall 16 extending forwardly from the lower edge of the rear wall 12. The upper edge of rear wall 12 forms a ledge or shelf 14 upon which one edge of the cap member 50 rests when assembled. The horizontal bottom wall 16 includes a front portion 18 onto which the rim member 30 is bonded, thereby leaving a substantial portion along the horizontal bottom wall 16 between the rear wall 12 and the rim member 30. This portion forms a primary passageway for water splashing out of the pool and over the rim and carries such water into the outlet conduit system (not shown). At spaced position along the main gutter member in the surface of lower wall 16 between rear wall 12 and the point at which the rim 30 is bonded thereto, one or more outlets are provided which lead into conduits to a surge tank and/or filter system. For purposes of this invention the disposal of this water once it is in the main gutter is not critical and any one of several known systems may be used.

The rim member 30 is formed of a tubular plastic material and includes a substantially vertical front wall 32, a horizontal bottom wall 34 extending rearwardly from the lower edge of the front wall 32, a top wall 36 extending rearwardly from the top edge of the front wall 32 a distance less than the distance the bottom wall 34 extends rearwardly therefrom, a lip 38 extending downwardly from the rear edge of the aforementioned top wall 36 and terminating in a lower edge spaced from the bottom wall 34, and an inclined rear wall 40 extending downwardly and rearwardly from the lower edge of the lip 38 and at an angle therefrom to connect with the rear edge of the bottom wall 34 thus forming an enclosed tubular shape. At the juncture of the lip 38 and upper edge of rear wall 40 there is formed a seat 41 which can receive the front edge of the cover or cap member 50. If desired, a separate seat block 40 may be bonded thereto to provide a more substantial seat and preventing dislodgement of the cap 50.

The cap member 50 is a flat plate which includes a plurality of perforations 52. The plate or cap 50 is assembled with one longitudinal edge resting on the upper edge 14 of the rear wall 12 of the main gutter member 10, while the other longitudinal edge rests upon seat 42. At spaced points along the wall a return outlet 44 may be provided through selected rim members 30, whereby filtered water may be returned into the swimming pool. This opening 44 may be in the form of a one-way valve or the like in a conventional manner.

Figure 3:
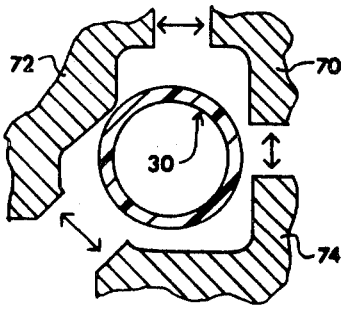
FIG. 3 is a sectional schematic representation of a mold suitable for forming the rim member.

Turning now to FIG. 3, there is illustrated a mold device formed of three mold members 70,72,74 which, when applied to a section of cylindrical stock material, form the stock material into the rim member 30. It is also contemplated that the main gutter member 10 be formed by sawing a cylindrical stock member longitudinally and forming at least one piece which can be molded into the shape illustrated in FIGS. 1 and 2. Also, cylindrical stock may be selected of such size as to allow the forming of two gutter sections therefrom or even perhaps a gutter section and flat plate member 50 from the same cylindrical stock material. In any event, after the cutting operation the material is heated, placed in the proper mold, and reshaped to form either the L-shaped main gutter member 10, the rim member 30, or the cover or cap 50.

While a preferred embodiment of the present invention has been described in detail hereinabove, it is apparent that various changes and modifications might be made to the disclosed embodiment without departing from the scope and intent of the invention which is set forth in the claims below.

What is claimed is:

1. The method of forming a gutter construction for swimming pools comprising the steps of:

(a) forming the deck and concrete side walls of the swimming pool leaving an L-shaped rectangular ledge connecting the upper edge of the side wall of the pool and the deck edge;

(b) heating and molding an L-shaped plastic main gutter member from a longitudinally slit piece of cylindrical tubular stock to form a main gutter member having a substantially vertical rear wall and horizontal bottom wall;

(c) mounting said main gutter member in said L-shaped ledge at the top of the side wall of the pool;

(d) forming a polygonal, tubular rim member by heating and molding a length of cylindrical tubular plastic stock material;

(e) bonding the bottom wall of said rim along the upper surface of the free front portion of said main gutter member to form a dual channel gutter therein with one passageway isolated from the other.

2. The method according to claim 1 further including the steps of forming a flat cover for said main gutter portion by cutting, heating and shaping a tubular section of stock material into a flat plate section and providing perforations therein, which cover member is laid loosely atop the main gutter member and rim member of steps (a) through (f).

* * * * *